United States Patent [19]

Goulet

[11] Patent Number: 4,683,854

[45] Date of Patent: Aug. 4, 1987

[54] ELECTRONIC AND MECHANICAL FUEL SUPPLY SYSTEM

[75] Inventor: Carl R. Goulet, Daphne, Ala.

[73] Assignee: Teledyne Industries, Inc., Los Angeles, Calif.

[21] Appl. No.: 702,416

[22] Filed: Feb. 15, 1985

[51] Int. Cl.[4] ..... F02M 51/00; F02B 77/00

[52] U.S. Cl. ..... 123/478; 123/198 D; 123/479; 123/472

[58] Field of Search ..... 123/472, 478, 479, 430, 123/198 D, 575; 60/223

[56] References Cited

U.S. PATENT DOCUMENTS

| | | | |
|---|---|---|---|
| 3,022,053 | 2/1962 | Hoyt | 261/18 |
| 3,834,361 | 9/1974 | Keely | 123/479 |
| 4,065,920 | 1/1978 | Minami et al. | 60/276 |
| 4,144,850 | 3/1979 | Asaka et al. | 123/52 |
| 4,291,532 | 9/1981 | Robinson | 123/198 D |
| 4,305,350 | 12/1981 | Brown et al. | 123/59 |
| 4,404,945 | 9/1983 | Fujikawa | 123/478 |
| 4,424,785 | 1/1984 | Ishida et al. | 123/478 |
| 4,452,207 | 6/1984 | Moore, Jr. | 123/478 |

*Primary Examiner*—Raymond A. Nelli

*Attorney, Agent, or Firm*—Gifford, Groh, VanOphem, Sheridan, Sprinkle and Dolgorukov

[57] ABSTRACT

An electronic and mechanical fuel feeding system comprises a mechanical fuel induction system coupled with an electronic fuel injection system through a diverter valve in fluid communication with a mechancial pump. The diverter valve includes a valve actuator responsive to an electrical signal to couple the inlet of the diverter valve with the outlet of the valve connected in fluid communication with electronically controlled injector nozzles. Alternatively, absence of an electrical control signal at the valve actuator causes coupling of the inlet of the diverter valve to a second outlet coupled in fluid communication with a mechanical carburetion system. In the preferred embodiment, the electronic fuel injection system comprises a control circuit responsive to changes in engine speed, manifold pressure, exhaust gas temperature and cylinder temperature so that accurately metered amounts of fuel are delivered by the injector nozzles to the engine cylinders. Since the amount of fuel supplied to the injector nozzles by a mechanical pump may exceed the amount necessary to efficiently operate the engine, a fuel return line downstream of the injector nozzles returns excess fuel to the fuel tank through a restricted orifice to prevent excess depletion of fuel at the injector nozzles.

18 Claims, 1 Drawing Figure

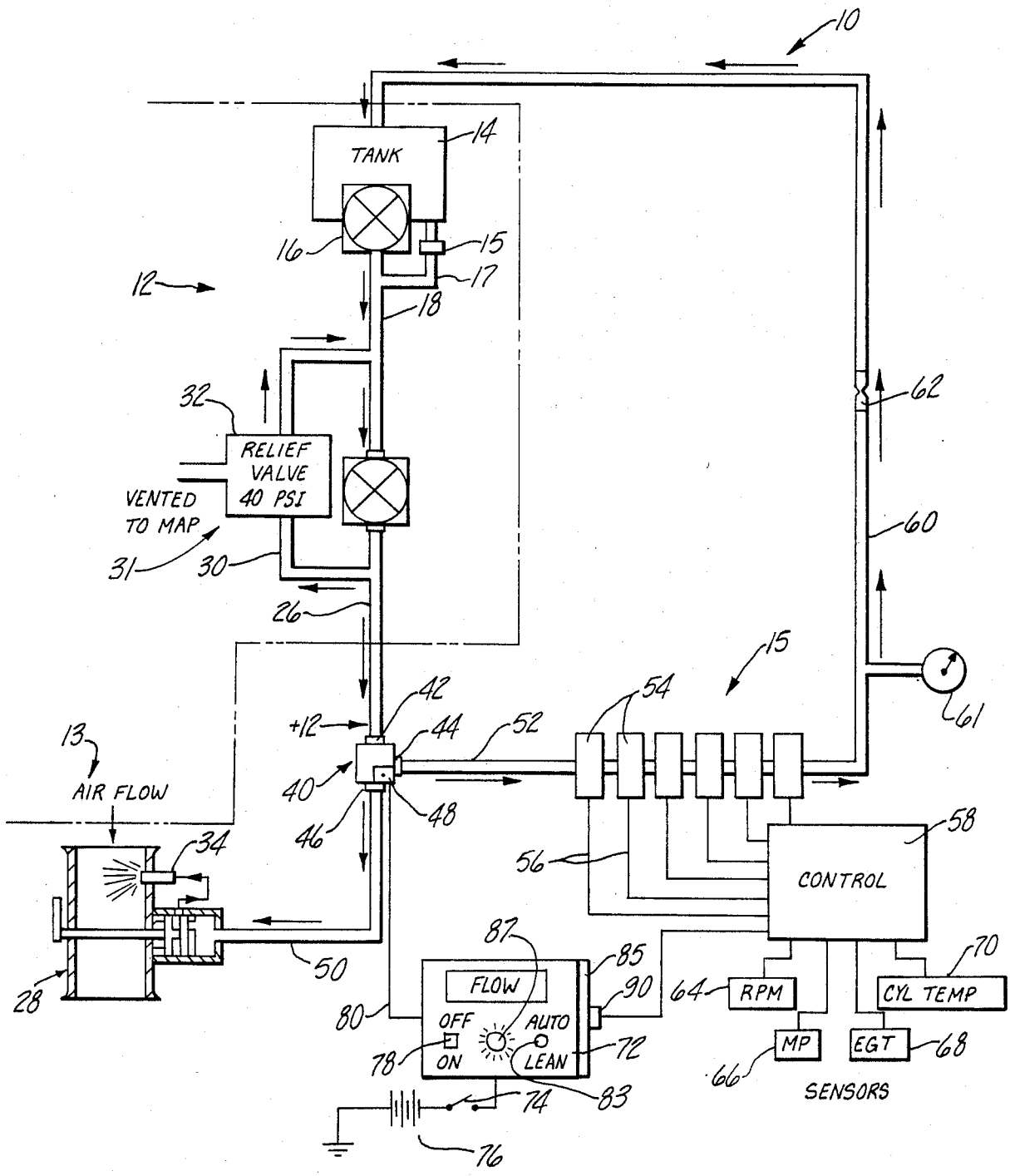
10
TANK
14
16
15
17
12
18
32
RELIEF VALVE 40 PSI
VENTED TO MAP
31
30
26
62
60
61
15
42
+12
44
52
54
13
AIR FLOW
40
46
48
34
56
58
CONTROL
28
50
87
85
FLOW
90
80
OFF
AUTO
78
ON
LEAN
72
83
74
76
64
RPM
70
CYL TEMP
MP
EGT
68
66
SENSORS

ELECTRONIC AND MECHANICAL FUEL SUPPLY SYSTEM

BACKGROUND OF THE INVENTION

I. Field of the Present Invention

The present invention relates generally to fuel inducting systems for internal combustion engines operating in aircraft, and more particularly to such a system having a mechanical fuel induction apparatus as well as an electronic fuel injection means to form a back up in the event of an electrical failure.

II. Description of the Prior Art

There are many previously known fuel induction systems for internal combustion engines. However, the internal combustion engines used in aircraft primarily utilize a hydro-mechanical fuel injection system although some aircraft engines do use a carburetor for fuel induction. In a known manner, the carburetion system comprises throttle linkage which controls the amount of fuel delivered to a carburetor throttling passage to be used for ignition in the engine cylinders. The carburetor is coupled to a manifold which directs the fuel mixture to the cylinders. However, while such systems are generally capable of providing a sufficient amount of fuel to the cylinders for operation of the engines throughout a wide range of engine speeds, variation in the amount of fuel delivered to each cylinders, and variations in richness of the fuel mixture can waste fuel and cause inefficient operation of the engine.

In order to overcome the above mentioned problems, hydro-mechanical fuel injection systems have been devised so that a properly metered amount of fuel can be delivered to each cylinder as is necessary. In general, such systems include a plurality of injection nozzles corresponding in number to the number of cylinders in the engine, whereby fuel is injected directly into each cylinder by a nozzle. The operation of the injection system is manually controlled by hydro-mechanical apparatus which can be varied in response to changing engine operating conditions such as temperature and engine speed. Moreover, such systems can be especially advantageous for use in aircraft engines for the reason that adverse effects occur due to changes in ambient pressure such as altitude changes and gravitational effects during maneuvering, or due to changes in engine operating conditions. As a result, most aircraft engines of the internal combustion type utilize fuel injection systems as opposed to carburetion systems.

However, since the fuel injection systems are controlled by the pilot of aircraft, the pilot must continuously read guages and indicators pertaining to enging operating conditions and lean or enrich the fuel mixture according to set standards provided by the engine manufacturer after making such readings. Unfortunately, failure to make the adjustments recommended by the manufacturer can adversely affect efficient engine performance and substantially reduce engine life. In particular, leaning of the fuel mixture is desired for optimum operation at cruise power, but excessive leaning can cause excessively high cylinder temperature resulting in reduced engine life and possible destruction of the engine. Moreover, although electronic fuel injection systems have been used in land vehicles, they have not been considered well adapted for use in aircraft.

In view of the fact that electrical power is necessary to operate electronic ignition systems, it would heretofore have been necessary to provide such aircraft with a back-up electrical system to prevent engine failure in the event that the primary electrical system fails. Unfortunately, it is possible that conditions which cause failure of the primary electrical system can also cause failure of the secondary electrical system, thereby rendering the aircraft inoperable and thus putting the aircraft, its passengers and crew in great danger. Moreover, a back-up electrical system can be complex and expensive to install, especially when the system must operate more than fuel injection apparatus.

SUMMARY OF THE PRESENT INVENTION

The present invention overcomes the above-mentioned disadvantages by providing a mechanical fuel injection system for use with internal combustion engines which use electronic fuel injection systems. The fuel induction system according to the present invention utilizes the existing known fuel supply system of the aircraft without modification, and employs the use of standard parts throughout so that the fuel feeding system can be readily serviced and maintained. Moreover, it will be understood that introduction of fuel to the engine cylinders is not solely dependent on the availability of electrical power, and thus, the system of the present invention avoids the need for complex back-up electrical systems heretofore required to maintain the operation of the aircraft as well as the possible risks incident to disruption of electrical power in the aircraft. Nevertheless, the electronic fuel injection system also includes a control circuit for automatically adjusting introduction of the fuel mixture to the cylinder in response to sensed operating conditions.

In general, the present invention comprises a previously known mechanical fuel induction system not generally used for aircraft engines with an automated electronic fuel injection system. Each system is coupled through an appropriate conduit means to the outlet of the fuel pump. The fluid conduit means includes a diverter valve whose inlet communicates with the fuel pump and which has two outlets. A first outlet of the diverter valve communicates with a plurality of injector nozzles, an injector nozzle being mounted for fluid communication with each of the cylinders of the engine by means of a port, an intake manifold, or the like. The second outlet communicates with a mechanical throttling device such as a carburetor mounted on an intake manifold.

Operation of the injector nozzles is controlled by an external control circuit having signalling means responsive to particular engine conditions. In the preferred embodiment, the control circuit responds to signals received from an exhaust gas temperature sensor, a cylinder temperature sensor, an engine speed sensor and a manifold pressure sensor. Moreover, the control system can be manually operated so that the electronic fuel injection system can be operated when malfunctions occur in the sensing devices or the automatic control circuit, and it includes means for automatically switching out of the automatic leaning mode.

In any event, the diverter valve includes valve actuating means which connects the inlet of the valve to the second outlet serving the mechanical fuel induction means when no electrical signal is available for the electronic ignition system. Conversely, application of an electrical signal to power the electronic ignition system actuates the value so the inlet communicates with the first outlet in fluid communication with the injector nozzles.

Since the electronic fuel induction system can more efficiently deliver a necessary amount of fuel to the cylinders, the amount of fuel delivered by the pump may exceed the needs of the cylinders under particular operating conditions. Moreover, when the engine is shutdown while hot, unused fuel remaining in the fuel lines vaporizes, and it is desirable to remove the vaporized fuel to avoid the risk of explosion. Consequently, a return line from the fluid conduit feeding the injector nozzles communicates with the fuel tank to recirculate unused fuel for subsequent use and cooling. Preferably, the return line includes a restricted orifice to prevent the depletion of a sufficient amount of fuel at the injection nozzles to properly operate the internal combustion engine and forms a pressure head which assures that fuel is forced into the cylinders despite variations in cylinder pressure. In addition, a relief valve regulator assures that the rail pressure i.e. the pressure in the fuel line at the injector nozzles, does not exceed a desirable level.

In light of the above description, it can be seen that the fuel feeding system of the present invention provides an instantaneously operable mechanical back-up to an electronic fuel injection apparatus. Moreover, the automatic control system avoids errors which were previously attributable to a pilots failure to operate the electronic fuel injection system in accordance with the manufacturer's specifications. Nevertheless, the automatic control can still be overidden by manual control of the pilot if necessary.

Furthermore, the system of the present invention requires no modifications to an existing aircraft fuel system in order to incorporate the dual fuel feeding system of the present invention. Moreover, each of the components utilized in the fuel feeding system can be provided by readily available automotive equipment components since the control circuitry enables the electronic fuel injection apparatus to be adjusted for use under aircraft operating conditions.

BRIEF DESCRIPTION OF THE DRAWING

The present invention will be more clearly understood by reference to the following detailed description of a preferred embodiment of the present invention when read in conjunction with the accompanying drawing in which:

FIG. 1 is a diagrammatical representation of the electronic and mechanical fuel feeding system of the present invention.

DETAILED DESCRIPTION OF A PREFERRED EMBODIMENT OF THE PRESENT INVENTION

The electronic and mechanical fuel induction system 10 according to the present invention is thereshown incorporated with the fuel supply system 12 of an aircraft engine. Fuel supply system 12 comprises a fuel tank 14 coupled through an electric pump 16 and a separate supply conduit 17 including a check valve 15 to a fluid passage means 18. The electric pump 16 is used to deliver fuel during starting of a cold engine or to purge vapor from the fuel lines after the hot engine has been shut off, while the check valve 15 closes the supply line 17 to prevent immediate return to the tank 14. In addition, the pump 16 provides a back up for a mechanical fuel pump 22. Alternatively, mechanical pump 22 draws fuel from the tank 14 through supply conduit 17. In any event, the fluid passage means 18 communicates with the inlet 20 of the mechanical pump 22. Preferably, the mechanical pump is operated by means of an accessory drive transmission driven by the aircraft engine to which fuel is to be supplied. The outlet 24 of the mechanical pump 22 is connected by second fluid passage means 26 to a carburetor 28 in a well known manner.

The supply system 12 also includes a rail pressure regulator 31 including a relief valve 32 vented to the manifold (not shown) and a feedback conduit means 30 which is connected at one end upstream of the mechanical pump inlet 20 while the other end is coupled in fluid communication downstream of the mechanical pump outlet 24.

Of course, it will be understood that the carburetor 28 is coupled to an intake manifold (not shown) in a well known manner so that the fuel provided to the carburetor from the fluid passage means 26, being intermixed with the air inducted into the carburetor, can be delivered to the cylinders of the internal combustion engine. Moreover, it is advantageous to employ mechanically operated jets 34 for positively delivering fuel to the air inducted into the carburetor 28 without adverse effects from changes in ambient pressure and dynamic forces during operation of the aircraft.

In the preferred embodiment of the present invention, a diverter valve 40 is inserted in the second fluid passage means 26 so that its inlet 42 is in fluid communication with the outlet 24 of pump 22. The diverter valve 40 includes first outlet 44 and a second outlet 46 as well as a valve actuating means 48 for selectively coupling the inlet 42 to the first outlet 44 or the second outlet 46. The second outlet 46 is coupled to the carburetor 28 by appropriate third fluid passage means 50. The first outlet 44 of the diverter valve 40 is coupled by fluid conduit means 52 to a plurality of injector nozzles 54.

The number of injector nozzles 54 corresponds to the number of cylinders in the internal combustion engine of the aircraft. Each injector nozzle 54 is mounted to discharge fuel directly into a cylinder of the engine or a fluid passageway communicating with the cylinder. The discharge is controlled by electrical signals delivered by electrical conductors 56 coupling the injector nozzles 54 to a control circuit 58 in a well known manner.

While each of the nozzles 54 is connected in fluid communication with fluid conduit means 52, the fluid conduit means 52 is also coupled in fluid communication with a return conduit means 60 downstream of the nozzles 54 and communicating with the fuel tank 14. The return conduit means 60 includes a conduit section having a restricted orifice as shown diagrammatically at 62 in the drawing to assure that the fuel is under sufficient pressure at the nozzles 54 and does not prematurely bypass the injector nozzles while continuing on toward fuel tank 14. A pressure guage 61 communicating with the return line 60 as diagrammatically shown in FIG. 1, monitors the rail pressure, and is preferably mounted for viewing by the pilot. As a result, the pilot is provided with a visible indication that the regulator 31 is operative or an indication of the status of a vapor purging operation.

The control circuit 58 is coupled to a plurality of sensing devices through appropriate conductors which transmit an electrical signal in response to the sensing of operating conditions. In particular, the control circuit 58 in the preferred embodiment of the present invention is coupled to a speed sensing apparatus 64, a manifold pressure sensor 66, an exhaust gas temperature sensor 68 and a cylinder temperature sensor 70. Of course, each sensor is remotely positioned from the control circuit 58 so that it is proximately positioned for sensing its respective condition. However, such sensors can be of a conventionally available type, and need not be described in further detail insofar as the present invention is concerned.

The control circuit 58 is coupled through a control panel 72 and switch 74 to electrical power supply 76. The control panel 72 includes means for automatically leaning the fuel/air mixture fed by the injector nozzles after the engine has operated at a constant speed for a predetermined time, and includes a light indicator 83 for signalling when the automatic leaning circuit is operating. The control panel 72 includes an on/off signal light 78 to indicate when the switch 74 is closed so as to provide electrical power to the control panel 72 as well as control circuit 58. The electrical signal is also applied through a conductor 80 to the valve actuator 48 which is preferably in the form of a solenoid connected to a valve gate. Upon receipt of the electrical signal, the valve actuator 48 couples the first outlet 44 with the inlet 42 of the diverter valve 40 to provide a flow of fuel into the injector nozzles 54. Alternatively, when the switch 74 is open, no electrical signal is applied to the conductor 80, whereby the valve actuating means 48 fluidly connects the inlet 42 with the second outlet 46 and blocks fuel flow to the first outlet 44 toward the injector nozzles 54.

As a result, it will be understood that upon failure of the electrical system, whereby electrical power is no longer provided to the control panel 72 or the control circuit 58, the diverter valve automatically diverts fuel to the carburetor 28 and bypasses the electronic fuel injection system 15. On the other hand, application of an electrical signal through switch 74 to the control panel 72 provides an electrical signal to the conductor 80 which reconnects the fuel supply system 12 to the electronically controlled injector nozzles. Moreover, when it is necessary to test the aircraft for no electrical power operation, switch 74 can be opened to simultate a no power condition. Nevertheless, the engine continues to receive sufficent fuel from the mechanical induction system 15. Furthermore, the control panel 72 also provides means for manually adjusting the fuel mixture delivered by the injector nozzles. Although the control circuit 58 will automatically enrich the mixture for cold starting, the automatic control is automatically deactivated when the control circuit 58 fails to respond within the operating standards required for safe, optimum operation. For example, if cylinder head temperature exceeds a critical temperature, but the control circuit 58 is unable to adjust the richness of the fuel mixture to compensate for the excessive heating, a switching means 90 automatically deactivates the automatic leaning circuit to permit manual control means 85 to be operated to adjust the fuel mixture to the required specification. An indicator light 87 indicates when the control circuit 58 has discontinued automatic operation and that the pilot must make further adjustments to the fuel mixture cylinders.

Having thus described my invention, many modifications thereto will become apparent to those skilled in the art to which it pertains without departing from the scope and spirit of the present invention as defined in the appended claims:

What is claimed is:

1. A fuel injection system for internal combustion engines including in combination:

(a) a fuel tank, (b) a mechanical fuel pump having an inlet and an outlet, with said inlet connected to said fuel tank, (c) a diverter valve having an inlet, a first outlet, a second outlet, said inlet of said diverter valve being connected to said outlet of said mechanical fuel pump, said diverter valve being movable between a first position in which said diverter inlet is fluidly connected to said first outlet and a second position in which said diverter inlet is fluidly connected to said second outlet, (d) a first fuel delivery system comprising electrically powered electronic fuel injection means for injecting metered amounts of fuel into each cylinder of said internal combustion engine, inlcuding at least one injector nozzle connected to said first outlet of said diverter valve, (e) a second fuel delivery system comprising carburation means for mechanically metering the introduction of fuel to the cylinders of said internal combustion engine connected to said second outlet of said diverter valve, (f) means responsive to an electric signal for moving said diverter valve to said first position, and (g) means responsive to the absence of electrical power for automatically moving said diverter valve from first and to said second position.

2. The device defined in claim 1, and further including return conduit means connected between a point downstream of said injector nozzle and said fuel tank, whereby excess fuel delivered by said pump to said injector nozzle is returned to said tank.

3. The device defined in claim 2, and including a restricted orifice interposed in said return conduit means.

4. The device defined in claim 3, and including a pressure gauge interposed between said restriced orifice and said injector nozzle.

5. The device defined in claim 4, and including a control circuit connected to each of said at least one injector nozzle.

6. The device defined in claim 5, and including a control panel connected to said control circuit and to said diverter valve moving means.

7. The device defined in claim 6, and including a relief valve interposed in between said inlet and said outlet of said mechanical fuel pump.

8. The device defined in claim 7, and including means for adjusting the amount of fuel discharged from said injector nozzle in response to at least one engine operating condition.

9. The device as defined in claim 8, wherein said adjusting means includes means for automatically leaning the fuel mixture after the engine has maintained a constant speed for a predetermined length of time.

10. The device defined in claim 8, wherein said adjusting means includes means for automatically adjusting the amount of fuel in response to changes in exhaust gas temperature.

11. The device defined in claim 8, wherein said adjusting means includes means for automatically adjusting the amount of fuel in response to changes in manifold pressure.

12. The device defined in claim 8, wherein said adjusting means includes means for automatically adjusting the amount of fuel in response to engine speed.

13. The device defined in claim 8, wherein said adjusting means includes means for automatically adjusting the amount of fuel in response to cylinder temperature.

14. The invention defined in claim 8, and further including switch means for automatically deactivating said means for automatically leaning the fuel mixture when said cylinder head exceeds a predetermined temperature.

15. The device defined in claim 5, and including an engine speed sensor connected to said control circuit.

16. The device defined in claim 5, and including a manifold pressure sensor connected to said control circuit.

17. The device defined in claim 5, and including an exhaust gas temperature sensor connected to said control circuit.

18. The device defined in claim 5, and including a cylinder temperature sensor connected to said control circuit.

* * * * *

UNITED STATES PATENT AND TRADEMARK OFFICE

CERTIFICATE OF CORRECTION

PATENT NO. : 4,683,854

DATED : August 4, 1987

INVENTOR(S) : Carl R. Goulet

It is certified that error appears in the above-identified patent and that said Letters Patent is hereby corrected as shown below:

Col. 1, line 28, delete "cylinders" and insert --cylinder--.

Col. 1, line 52, delete "enging" and insert --engine--.

Col. 2, line 68, delete "value" and insert --valve--.

Col. 6, line 17, delete "inlcuding" and insert --including--.

Col. 6, line 29 after "from", insert --said--;

Col. 6, line 29, delete "and" and insert --position--.

Signed and Sealed this

Twenty-ninth Day of December, 1987

*Attest:*

DONALD J. QUIGG

*Attesting Officer*

*Commissioner of Patents and Trademarks*